US005733104A

United States Patent [19]

Conrad et al.

[11] Patent Number: 5,733,104

[45] Date of Patent: Mar. 31, 1998

[54] VACUUM PUMP SYSTEM

[75] Inventors: Armin Conrad, Herborn Hörbach; Otto Ganschow, Hürth, both of Germany

[73] Assignee: Balzers-Pfeiffer GmbH, Asslar, Germany

[21] Appl. No.: 516,244

[22] Filed: Aug. 17, 1995

Related U.S. Application Data

[63] Continuation-in-part of Ser. No. 172,685, Dec. 23, 1993, abandoned.

[30] Foreign Application Priority Data

Dec. 24, 1992 [DE] Germany ..... 42 44 191.9
Sep. 17, 1993 [DE] Germany ..... 43 31 589.5

[51] Int. Cl.[6] ..... F04B 25/00

[52] U.S. Cl. ..... 417/44.1; 417/202; 417/250; 417/423.4; 417/425.5

[58] Field of Search ..... 417/44.1, 45, 44.11, 417/202, 203, 205, 250, 423.4, 423.5, 249, 266; 415/90, 143; 73/40.7

[56] References Cited

U.S. PATENT DOCUMENTS

| | | | |
|---|---|---|---|
| 3,536,418 | 10/1970 | Breaux . | |
| 3,753,623 | 8/1973 | Wutz | 415/90 |
| 3,947,193 | 3/1976 | Maurice | 415/143 |
| 4,057,369 | 11/1977 | Isenberg et al. | 417/423.4 |
| 4,111,595 | 9/1978 | Becker et al. | 415/90 |
| 4,140,441 | 2/1979 | Patterson | 417/423.4 |
| 4,505,647 | 3/1985 | Alloca et al. . | |
| 4,621,985 | 11/1986 | Kobayashi et al. | 417/250 |
| 4,637,779 | 1/1987 | Sherman et al. | 415/143 |
| 4,773,256 | 9/1988 | Saulgeot | 73/40.7 |
| 4,850,806 | 7/1989 | Morgan et al. | 417/250 |
| 4,919,599 | 4/1990 | Reich et al. | 417/423.4 |
| 5,039,280 | 8/1991 | Saulgeot et al. | 417/205 |
| 5,116,196 | 5/1992 | Baret et al. | 415/89 |
| 5,238,362 | 8/1993 | Casaro et al. | 415/90 |
| 5,259,735 | 11/1993 | Takahashi et al. | 417/203 |
| 5,297,422 | 3/1994 | Baret | 73/40.7 |
| 5,341,671 | 8/1994 | Baret et al. | 73/40.7 |

FOREIGN PATENT DOCUMENTS

| | | |
|---|---|---|
| 0344345 | 6/1988 | European Pat. Off. . |
| 0343914 | 5/1989 | European Pat. Off. . |
| 0397051 | 5/1990 | European Pat. Off. . |
| 0472933 | 7/1991 | European Pat. Off. . |
| 2236545 | 6/1974 | France . |
| 1934936 | 7/1969 | Germany . |
| 2049117 | 10/1970 | Germany . |
| 236967 | 5/1985 | Germany . |
| 3639512 | 11/1986 | Germany . |
| 3710782 | 3/1987 | Germany . |

OTHER PUBLICATIONS

A Conrad et al., Comparison of Holweck– and Gaede–pumping stages, Vacuum, vol. 44, Nos. 5–7, pp. 681 to 684/1993.

*Primary Examiner*—Timothy Thorpe
*Assistant Examiner*—Peter G. Kurytnyk
*Attorney, Agent, or Firm*—Anderson, Kill & Olick, P.C.

[57] ABSTRACT

A vacuum pump system for multi-stage gas inlet systems and including a pumping unit formed of a turbomolecular pump and one or several further pumps arranged downstream of the turbomolecular pump and the rotors of which are located on the same shaft as the rotor of the turbomolecular pump, and an additional intermittently operated dry running pump, which discharges against atmospheric pressure.

8 Claims, 6 Drawing Sheets

VACUUM PUMP SYSTEM

RELATED APPLICATIONS

This application is a continuation-in-part of the application Ser. No. 08/172,685, filed on Dec. 23, 1993 for "Vacuum Pump System, now abandoned."

FIELD OF THE INVENTION

The present invention relates to a vacuum pump system for a multi-stage gas inlet system, which vacuum pump system includes a multi-stage turbomolecular pump having a plurality of rotor and stator discs, and one or several pump stages, with each stage being formed by a pump the rotor of which is supported on the same shaft that supports the rotor discs of the turbomolecular pump, with the pumps defining the pump stages being arranged one after another in the direction of a fore-vacuum side, and with the turbomolecular pump and the pumps defining the pump stage forming a first pumping unit which is followed by a dry pump stage discharging against the atmospheric pressure.

BACKGROUND OF THE INVENTION

For purposes of gas analysis, the substances which have to be examined, which are available in a gaseous form or in the form of liquids, must be brought into a gaseous state which is specific for the analyzing instrument. As a rule, this occurs in a system of interconnected vacuum chambers. In these chambers, the substance which is either already introduced in the gaseous state or which is a liquid which has been brought into the gaseous state by appropriate pressure or other processes, is reduced, in different steps, down to the working pressure of the analyzing instrument. The system of vacuum chambers consists of several intermediate stages, which are separated from each other by screens. Different pressures, which are predetermined by the analyzing method, exist in the individual chambers.

In conventional systems, the vacuum chambers are, respectively, individually provided with vacuum pumps or pumping systems, which provide the required pressure or the suction capacity. As a rule, pumps which have different functional modes and different types of drive are required for this purpose. In lower pressure ranges, pump combinations are necessary (i.e. turbomolecular pumps which have backing or fore pumps). Such installations are very expensive. They also require a large space and involve high costs.

SUMMARY OF THE INVENTION

It is an object of the present invention to provide an efficiently operating vacuum pump system for gas analyzing systems which is less complicated, less expensive, and requires less space.

This object is achieved by providing a vacuum pump system of the above-described type, in which the suction connections, provided between the individual stages, are dimensioned and arranged as a function of the pressure relationships and the suction capacities of the individual pumps defining the pumping stages, and the return flows from the point of the outlet pressure level to the point of the inlet pressure level, within one pump stage, are small compared to the gas flow between those vacuum chambers which are connected with the point of the outlet level and the point of the inlet level.

The operating pressure of turbomolecular pumps is limited in the direction of the higher pressure, since they are only fully effective in the molecular flow range. Therefore, they only work in combination with fore vacuum pumps. As a rule, these are two-stage rotary vane pumps. In the past, the working pressure of turbomolecular pumps has been expanded in the direction of higher pressures, by attaching, for instance, a molecular pump of the type such as a Holweck pump, after the turbomolecular pump. This makes it possible to reduce the cost for producing the fore vacuum according to pump size and final pressure. In particular, it is possible to replace vacuum pumps using oil as operational medium with vacuum dry running pumps, i.e., pumps operating without the use of fluid operational medium, for instance, diaphragm pumps. These have given a particularly good account of themselves in cases where an oil-free vacuum is specified.

New task definitions result from the use of compact pump systems, and possibly, those as described above. The problem of the dimensioning of pressure ratios and the suction ability, which are required for the individual vacuum chambers, could be solved by using separate pumps individually for the respective vacuum chambers. However, with a compact pump system this is no longer possible. Here, it must be achieved by precise dimension and disposition of the suction connections, that feedbacks between the inlet and outlet of the individual pump stages are reduced to such an extent, that the function of the individual stages of the gas inlet system is not impaired. This is achieved by dimensioning the suction connection according to the present invention, as described above.

The suction connections are connected by a system of conduits which have connection flanges. In order to be able to easily establish a connection between the individual vacuum chambers and the connection flanges, these connection flanges can be disposed, for instance, in one plane with a high vacuum flange. A right angled arrangement, at the top side and side faces of, for instance, a tetrahedral pump housing, is also possible.

A comparison between different stages of molecular pumps shows that a Holweck pump, in particular, for high gas throughputs, has distinct advantages compared to other types of constructions, among other things, as far as vacuum technology data in connection with the geometric dimensions, are concerned.

For further refinements of the invention and for dimensioning and positioning of the different components, and especially, the individual pump stages, the pressures between the individual pump stages and their compression ratios are calculated with reference to FIG. 1, on the basis of the gas loads and the transfer conductance between the chambers. The obtained characteristic data permits the designing of the pump according to known methods.

FIG. 1 shows the typical application of a system of pumps of the present invention, which is typically, a so-called split flow pump in an analysis instrument, in the example of a multi-chamber arrangement. The measuring gas is, in this case, forced by atmospheric pressure through a capillary tube and into a first chamber which is pumped by a fore pump 102. The pump stages 103, 104 and 105 pump the gas flow $Q_3$, $Q_4$ and $Q_5$ which result from the transfer conductances $C_{23}$, $C_{34}$ and $C_{45}$.

If $S_{2i}$–$S_{5i}$ represents the "inner" suction capacity, without losses, which can be calculated according to known rules, and if $S_i$ represents the "outer" effective suction capacities diminished by the conductance losses $C_2$–$C_5$, and if $K_{023}$, $K_{034}$ and $K_{45}$ represent the inside pressure ratios at zero throughput, through the stages 103, 104 and 105, then the following relationship characteristic for the pumps, between the gas quantities $Q_3$–$Q_5$ which are entering and the pressures $P_3$–$P_5$ in the chambers, can be expressed according to the matrix equation (1):

$$\begin{pmatrix} P_3 \\ P_4 \\ P_5 \end{pmatrix} = \begin{pmatrix} \frac{1}{S_3} & \frac{1}{S_{3i}} & \frac{1}{S_{3i}} \\ \frac{1}{S3iKo_{34}} & \frac{1}{S_4} & \frac{1}{S_{4i}} \\ \frac{1}{S_{3i}Ko_{35}} & \frac{1}{S_{4i}Ko_{45}} & \frac{1}{S_5} \end{pmatrix} \cdot \begin{pmatrix} Q_3 \\ Q_4 \\ Q_5 \end{pmatrix} \quad (1)$$

Herein, the origin of the gas flow $Q_i$ is of no importance. In the case of molecular flow, such an equation can be established for every type of gas in an entering mixture since the individual components do not interact.

If one considers the case wherein the flows $Q_i$ for i>1, all of which flows emanate from $Q_1$ as shown in FIG. 1, then as a rule, the pressure levels of the pumped-out gas flows diminish greatly from chamber to chamber (i.e. $P_2 >> P_3 >> P_4 >> P_5$ and $Q_i >> Q_2 >> Q_3 >> Q_4 >> Q_5$). Therefore, the following simple relationship results as shown by equation (2) below:

$$\begin{pmatrix} Q_3 \\ Q_4 \\ Q_5 \end{pmatrix} \simeq \begin{pmatrix} P_2 \cdot C_{23} \\ P_3 \cdot C_{34} \\ P_4 \cdot C_{45} \end{pmatrix} \quad (2)$$

$$P_2 \simeq \frac{Q_1}{S_2} \quad (3)$$

The combination of equations (1) and (2) facilitates the calculation of the pressure ratios $K_{23}$, $K_{34}$ and $K_{45}$ between the chambers at given conductance values $C_{i,\ i+1}$ of the system to be pumped. The assumptions required for the design of the individual steps of the pumps result from the pressures $P_i$ which are required for the function of the system together with the suction capacities calculated therefrom.

$$K_{23} = S_3/C_{23} \quad (4)$$

$$K_{34} = \frac{S_4/C_{34}}{1 + \frac{S_4/C_{34}}{Ko_{34}} \cdot \frac{S_3}{S_{3i}}} \quad (5)$$

$$K_{45} = \frac{S_5/C_{45}}{1 + \frac{K_{34}}{Ko_{35}} \cdot \frac{S_5}{C_{45}} \cdot \left( \frac{S_3}{S_{3i}} + \frac{C_{34}}{S_{4i}} \cdot Ko_{34} \right)} \quad (6)$$

The equations (3), (4), (5) and (6) define all of the chamber pressures $P_{2\text{-}5}$.

Instructions for the optimum design and dimensioning of the vacuum technology characteristics of the pump system result from the above-noted logical relationships. For instance, as is seen from equation (5), the pressure ratio $K_{34}$, which is established in operation between the chambers 103 and 104, is defined, among other things, by the magnitude $Ko_{34}$. This magnitude can be affected by design measures. In order to render the pressure ratio $K_{34}$ to be large, $Ko_{34}$ must also be as large as possible. This is achieved by designing the channel depth of the Holweck stage at the level of the corresponding suction connection in a manner which corresponds to a vacuum pump system wherein the downstream pumping stage is a molecular pump of the Holweck pump type, and that the return flow, which is counter to the pumping direction, is greatly diminished. For this purpose, the channel depth is reduced at the point of the suction connection.

Since the Holweck stage must have a sufficiently high suction capacity at its entry side in order to be able to handle the gas quantity which is conveyed by the last pump stage of the turbomolecular pump, a correspondingly large channel depth must exist to this point. As a result, the channel depth increases continuously, or in stages, from the front of the suction connection, counter to the pumping direction, up to the inlet side. The pressure levels at other points of the pumping system can be controlled by varying the channel depth.

The Holweck stage must handle additional gas quantities at the point of the suction connection. In order to adapt the suction capacity, in the pumping direction, to the larger gas quantity, the channel depth must again be increased in the pumping direction starting from this point.

A vacuum pump system, wherein the profile of the Holweck pump stage, at the level of the suction junction, is designed in such a manner that the channel depth is reduced in a direction of the side of the low pressure and then again increases toward the inlet side of the pumping stage, to such an extent that the gas quantity of the preceding stage can be handled and a vacuum pump system, wherein the channel depth is larger from the point of the suction junction in the pumping direction than in an opposite direction, serves for increasing the conductance values $C_3$ to $C_5$ and for improving the suction capacities $S_2$ to $S_5$, which again, as a result of the above logical derivation, leads to an increase of the pressure ratios $K_{23}$, $K_{34}$ and $K_{45}$.

As described above, it is sensible in certain application cases, to design a pump which delivers, against atmospheric pressure, as a diaphragm pump.

Diaphragm pumps, however, have the disadvantage that their useful life is limited by the continuous elastic deformation of the diaphragms which seal the suction space. In order to utilize the advantages of the diaphragm pumps in vacuum systems, the useful period of operation of which is greater than the useful life of the diaphragm pumps, it is desirable to operate at intervals.

Herein, it is important that attention be paid so that the pressure fluctuations, which arise because of operation at intervals, does not impair the mode of functioning of the overall system. Therefore, the pump stage, to which output the diaphragm pump is connected, must have a sufficiently high pressure ratio.

The control of the operation at intervals, meaning the switching on and off of the diaphragm pump, must occur as a function of the fore vacuum pressure. Within certain limits, the current or power use of the turbomolecular pump is a measure for the fore vacuum pressure. This results in an elegant control measure because these values can be easily varied by the electronic drive system.

A diaphragm pump is described, as an example, for a pump stage which pumps against atmospheric pressure. The present invention deals, however, also with any type of a dry running fore pump.

In order to avoid condensation in the pump system, absorption and/or other suitable agents are provided between the pump stages and the stages of the gas analysis system.

BRIEF DESCRIPTION OF THE DRAWINGS

The objects and advantages of the present invention will become more apparent and the invention itself will be best understood from the following detailed description of the Preferred Embodiment, when read with reference to the accompanying drawings, wherein.

DETAILED DESCRIPTION OF THE PREFERRED EMBODIMENTS

Figure 1:
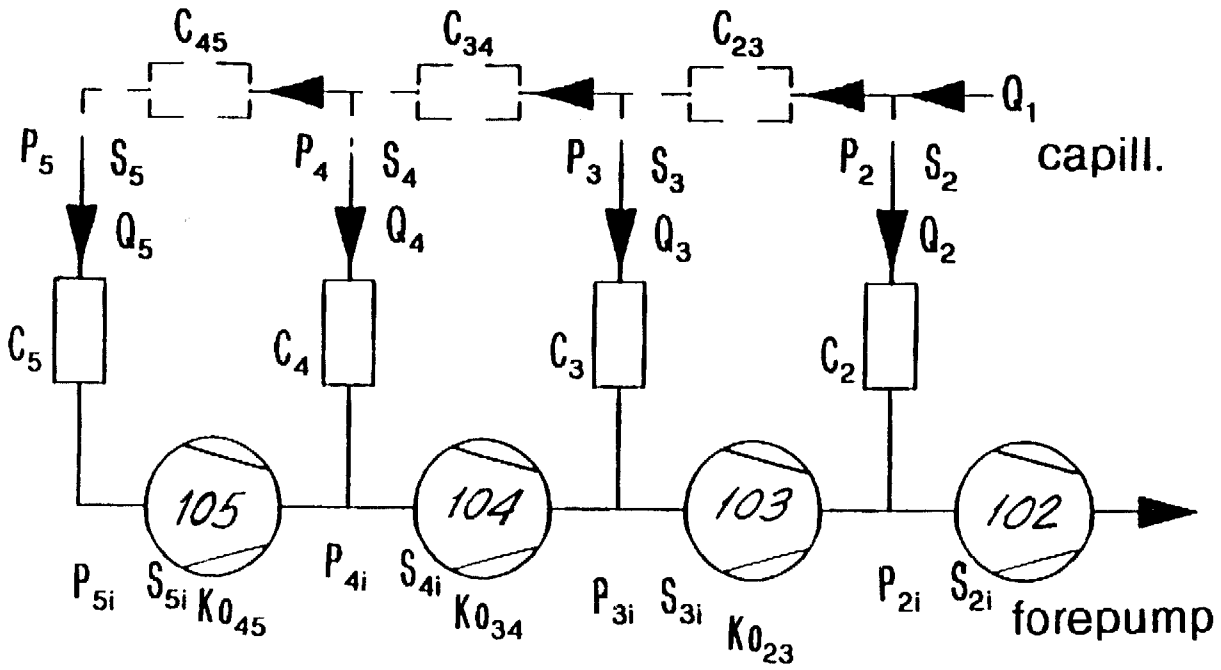
FIG. 1 shows a typical application of a system of pumps according to the present invention.
Figure 2:
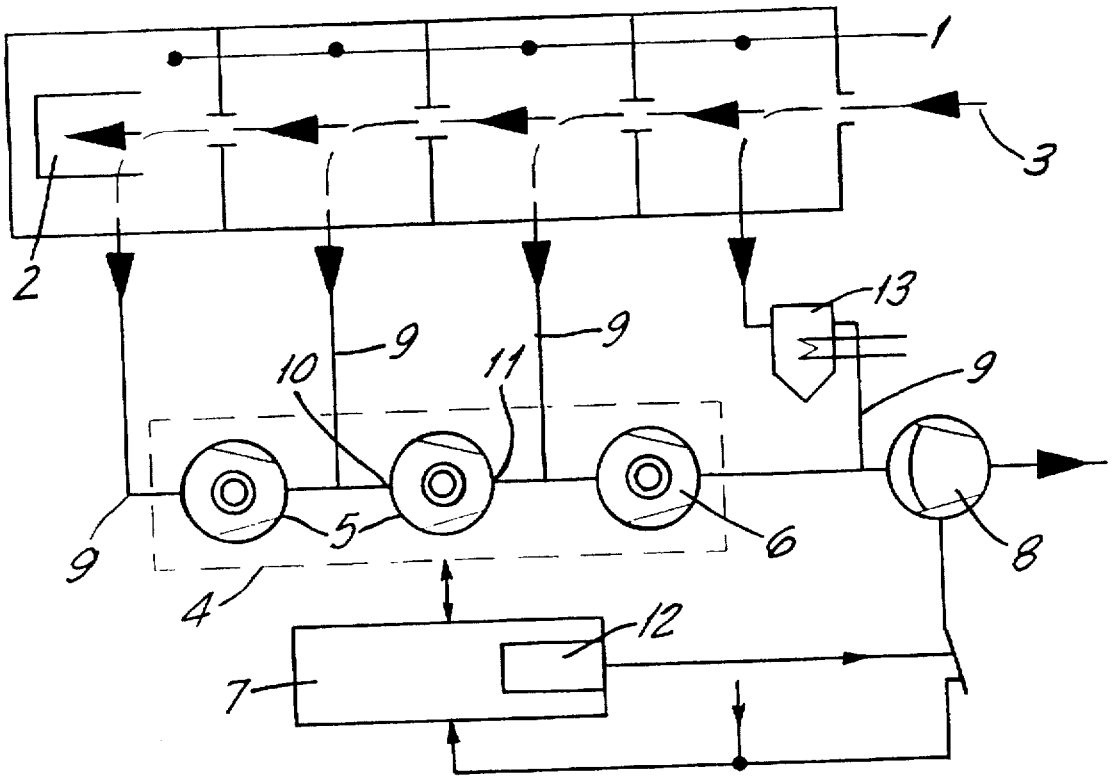
FIG. 2 shows a diagrammatic view of the pump system, according to the present invention, in connection with a gas inlet system.
Figure 3:
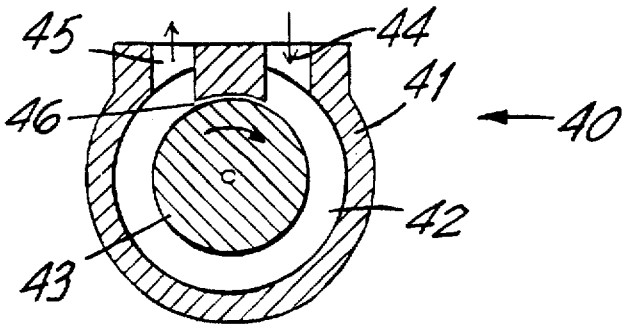
FIG. 3 shows schematic cross-sectional view of a Gaede pump.

The pump system according to the present invention, is shown schematically, in connection with a gas inlet system, in FIG. 2. A gas inlet system shown in FIG. 2 and which consists of several chambers 1 for a gas analysis apparatus or instrument 2 and has a gas inlet 3, is evacuated by a vacuum pump system according to the present invention. In FIG. 2, the inventive vacuum pump system includes a first pumping unit 4. This pumping unit 4 is composed of a multi-stage turbomolecular pump 5 and a molecular pump 6, for instance, a Holweck pump or a Gaede Pump.

The Gaede pump 40 comprises a cylindrical housing 41 in the cavity 42 of which a rotor 43 rotates. The suction side 44 of the Gaede pump communicates with the pressure side 45 via a sealed gap 46. Due to the collision of the particles with the rotor surface, they are communicated from the suction side 44 to the pressure side 45.

Figure 4:
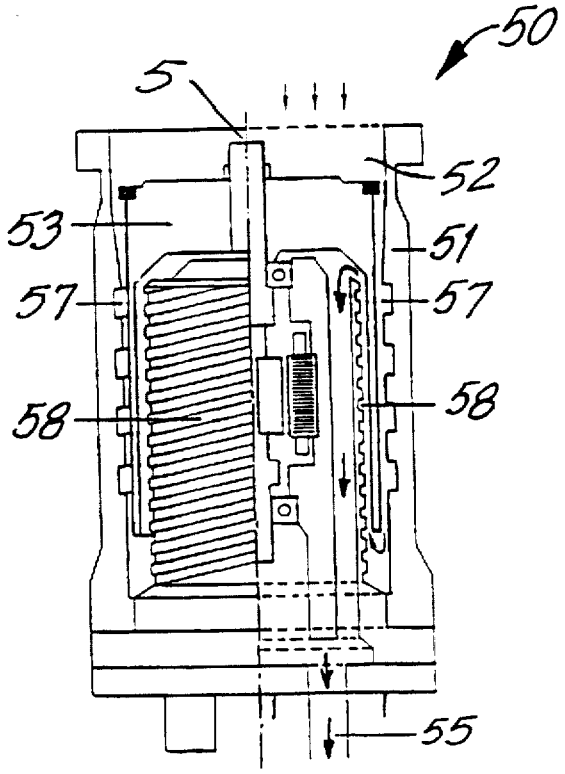
FIG. 4 shows a schematic cross-sectional view of a Holweck pump.

The Holweck pump, which is shown in FIG. 4, operates on the same principle as a Gaede pump, i.e. the gas particles from the suction side 54 are communicated to the pressure side 55 due to their collision with the surface of the rotor 53 which rotates in a cavity 52 of housing 51 of the Holweck pump 50. The inner wall of the housing 51 has a spiral groove 57 which, together with a spiral groove 58 provided inside the rotor 53, forms a second stage, so that gas particles communicate from the suction side 54 to the pressure side 55 in two stages.

The individual pumps 5 and 6 defining the individual stages of the first pumping unit 4 are interconnected to the extent that they are located in a common housing, and the rotors are installed on a common shaft. This arrangement makes it possible to operate the entire first pumping unit with a single common motor, which is driven by a drive electronic system 7.

in addition, the vacuum pump system includes a dry vacuum pump 8, with a control unit 12, which pumps against atmospheric pressure. This control unit 12 is integrated into the electronic drive system 7 of the first pumping unit 4. Suction or low pressure connections 9 are placed between the individual stages, which are defined by pumps 5 and 6, of the first pumping unit 4 and between the first pumping unit 4 and the pump 8. Using the central stage of the first pumping unit as an example, the inlet pressure level at the point 10 and the discharge pressure level at the point 11 are defined. An absorption or condensation device is designated by the reference numeral 13, and is located between the vacuum pump system and a stage of the gas analysis system.

Figure 5:
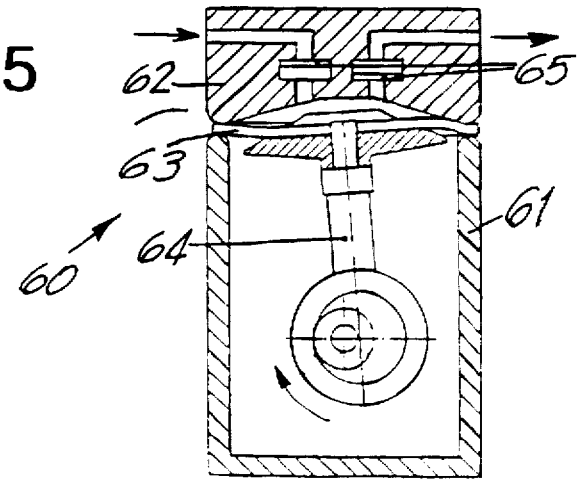
FIG. 5 shows a schematic cross-sectional view of a diaphragm pump.

As a dry vacuum pump 8, a diaphragm pump 60 shown in FIG. 5, is used. The diaphragm pump 60 has, as known, a housing 61 and a pump head 62. A diaphragm 63 is clamped between the housing 61 and the pump head 62. A connecting rod 64 oscillates the diaphragm 63, resulting in increase or decrease of the pump chamber 66, with gas being delivered in a direction, indicated by arrows, by periodically opening and closing valves 65.

Figure 6:
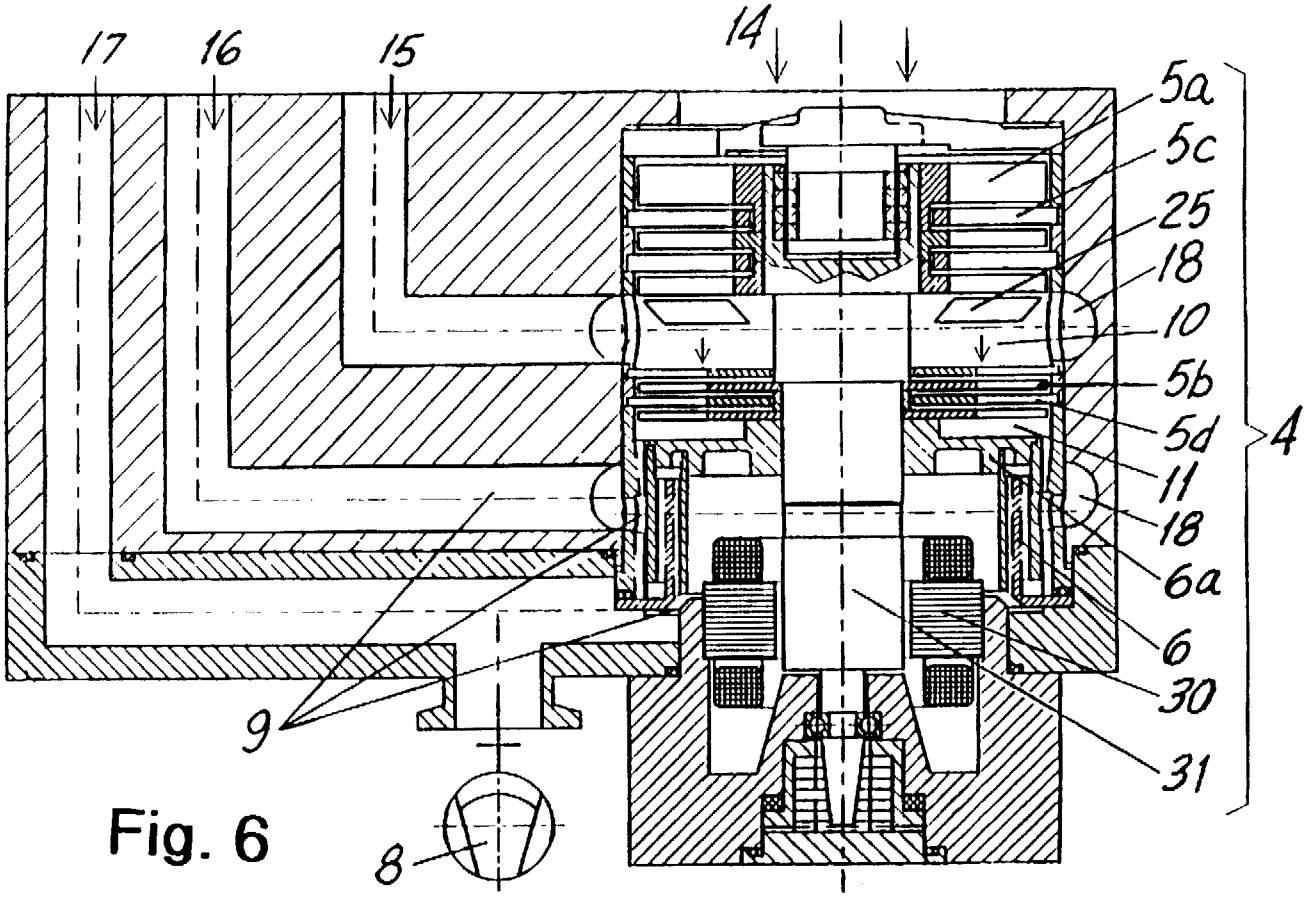
FIG. 6 shows a cross-sectional view of a first embodiment of the first pumping unit.

FIG. 6 illustrates the pumping unit 4 as a combination of a two-stage turbomolecular pump 5 stages, 5*c*, 5*d*, and a Holweck pump 6. The rotor 6*a* of the Holweck pump 6 is driven by a motor 30, via a shaft 31, which also drives the rotor discs 5*a*, 5*b*. The suction connections 9 are connected to connection flanges 15, 16, 17, which are arranged in the same plane as a high vacuum flange 14. Annular channels 18 are provided for increasing the conductance and, therefore, the suction capacity at the point of the suction connections 9, which annular channels establish an open connection between the suction connections and the pumping space. The turbomolecular pump 5 includes a plurality of stationary guide vanes 25 at a location between the two stages of the pump 5.

Figure 7:
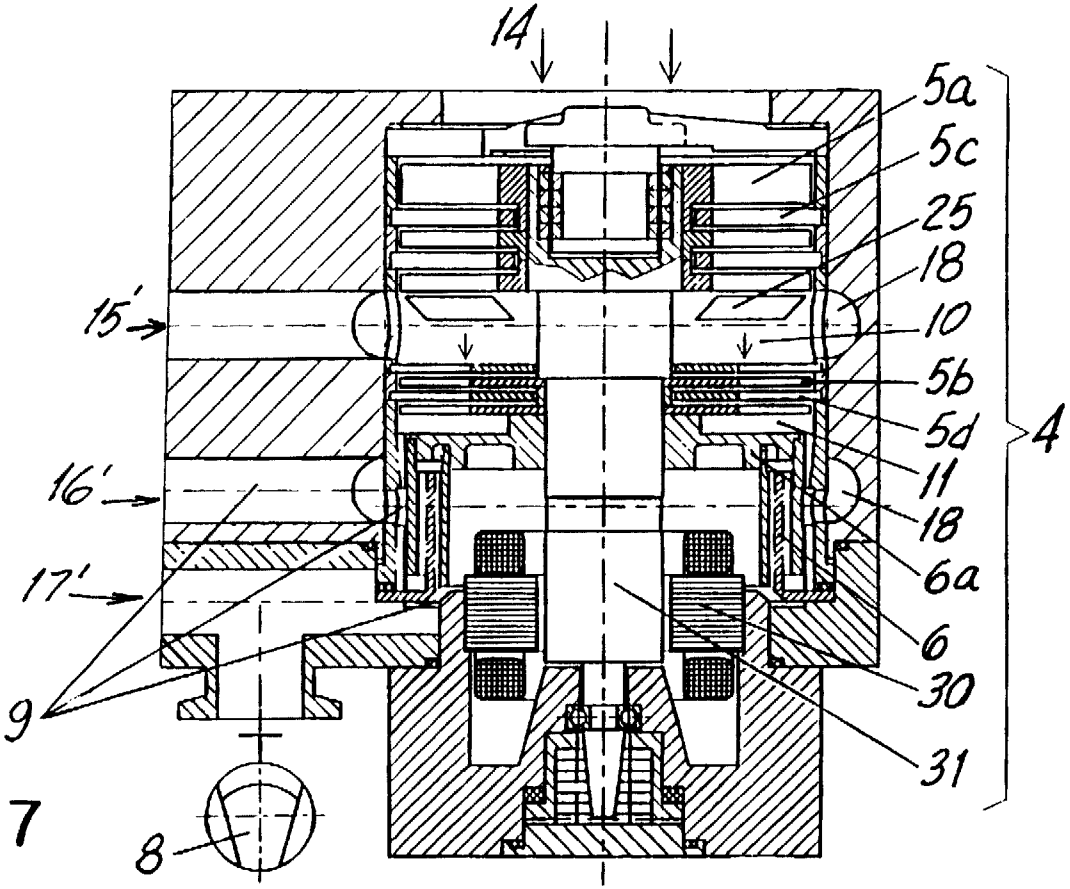
FIG. 7 shows a cross-sectional view of a second embodiment of the first pumping unit.

The pumping unit $4^1$ shown in FIG. 7 is substantially similar to the pumping unit 4 shown in FIG. 6 and, therefore, the identical elements will be designated with the same reference numerals. The only difference between the pumping units 4 and $4^1$ shown in FIGS. 6 and 7, respectively, consists in that the connection flanges $15^1$, $16^1$ and $17^1$ are arranged in a plane which extends perpendicular to the plane of the high vacuum flange 14.

Figure 8:
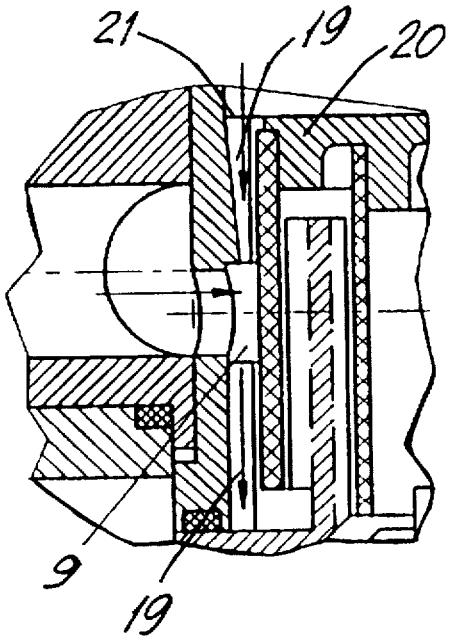
FIG. 8 shows a cross-sectional cut-out view of FIG. 6 at the point where the suction pump discharges into the Holweck pump.

FIG. 8 illustrates a cutout view from the downstream pumping stage 6, which is a pump of the Holweck type. The cutout of FIG. 8 illustrates the area, where one of the suction connections 9 discharges into the channel 19 of the Holweck pump. The rotating part is designated by the reference numeral 20. The pumping direction is indicated by arrows. In the area where the suction connection 9 discharges into the channel 19 of the Holweck pump, the channel is reduced, in depth in an opposite pumping direction in order to increase towards the inlet side 21. From the suction connection in the pumping direction, the channel depth is greater than in an opposite direction.

While the present invention has been described in a preferred embodiment such is merely illustrative of the present invention and is not to be construed as a limitation thereof. Accordingly, the present invention includes all modifications, variations and/or alternate embodiments with the scope of the present invention limited only by the claims which follow.

What is claimed is:

1. A vacuum pump system for a multi-stage gas inlet system having a plurality of vacuum chambers said vacuum pump system comprising:

a multi-stage turbomolecular pump with each separate stage having stator means, rotor means supported on a common shaft, an inlet side, and an outlet side;

at least one pumping stage located downstream of said turbomolecular pump and having a rotor, which is supported on said common shaft, an inlet side and an outlet side, said turbomolecular pump and said at least one pumping stage forming a first pumping unit;

a dry pumping stage located downstream of said at least one pumping stage and discharging against atmosphere; and a plurality of suction connections connecting the inlet and outlet sides of the stages of said multi-stage turbomolecular pump and said at least one pumping stage with respective vacuum chambers of the gas inlet system.

wherein said suction connections are dimensioned and arranged with regard to pressure ratios and suction capacities of individual stages of said turbomolecular pump and said at least one pumping stage according to the equation:

$$K_{34} = \frac{S_4/C_{34}}{1 + \frac{S_4/C_{34}}{KO_{34}} \cdot \frac{S_3}{S_{3i}}}$$

wherein: $K_{34}$ is a pressure ratio between adjacent first and second stages (103 and 104), $S_3$ and $S_4$—are suction capacities of said adjacent stages (103, 104), respectively, $C_{34}$—is a transfer conductance between said stages (103 and 104), $KO_{34}$—is an inside pressure ratio of second stage (104) at zero throughput, and $S_{31}$ is an inner suction capacity of first stage (103), whereby a return flow from the outlet side to the inlet side of each stage of said multi-stage turbomolecular pump and of said at least one pumping stage is small in comparison with a gas flow between two vacuum chambers connected with respective inlet and outlet sides.

2. A vacuum pump system according to claim 1, further comprising a high vacuum flange and a plurality of connection flanges disposed in a same plane as said high vacuum flange, said suction connection being connected with respective connection flanges.

3. A vacuum pump system according to claim 1, further comprising a high vacuum flange and a plurality of connection flanges located in a plane extending perpendicular to a plane in which said high vacuum flange is located.

4. A vacuum pump system according to claim 1, wherein said at least one pumping stage comprises a molecular pump.

5. A vacuum pump system according to claim 4, wherein said molecular pump is one of a Holweck pump and a Gaede pump.

6. A vacuum pump system according to claim 1, wherein said turbomolecular pump has two stages, wherein one of said suction connection extends from a location between the two stages, and wherein said turbomolecular pump comprises a plurality of stationary guide vanes at said location between the two stages which are formed so that a gas flow is directed in a direction of pumping channels of said turbomolecular pump.

7. A vacuum pump system according to claim 1, wherein said first pumping unit has an electronic control system for controlling operation of a drive motor, said control system including means for controlling operation of said dry pumping stage.

8. A vacuum pump system according to claim 1, further comprising at least one of absorption means and condensation means for removing condensate from a gas flow, said at least one of absorption means and condensation means comprising at least one device located at a point between said vacuum pump system and said gas inlet system.

* * * * *